United States Patent [19]

Novak et al.

[11] Patent Number: 4,636,593

[45] Date of Patent: Jan. 13, 1987

[54] LIGHT CONDUCTING, ELASTOMERIC MEMBRANE KEYPAD

[75] Inventors: Carl V. Novak, Pell Lake, Wis.; Ronald R. Browne, Des Plaines, Ill.

[73] Assignee: Motorola Inc., Schaumburg, Ill.

[21] Appl. No.: 854,730

[22] Filed: Apr. 17, 1986

Related U.S. Application Data

[63] Continuation of Ser. No. 711,425, Mar. 13, 1985, abandoned.

[51] Int. Cl.[4] ..... H01H 3/12

[52] U.S. Cl. ..... 200/5 A; 200/159 B; 200/313

[58] Field of Search ..... 200/5 A, 86 R, 159 B, 200/314, 313, 317, 365 R

[56] References Cited

U.S. PATENT DOCUMENTS

| | | | |
|---|---|---|---|
| 3,699,294 | 10/1972 | Sudduth | 200/243 |
| 4,022,993 | 5/1977 | Shattuck | 200/5 A |
| 4,163,138 | 7/1979 | Harden | 200/310 |
| 4,163,883 | 8/1979 | Boulanger | 200/314 |
| 4,343,975 | 8/1982 | Sado | 200/314 |
| 4,356,625 | 8/1983 | Bebie | 200/5 A |
| 4,449,024 | 5/1984 | Stracener | 200/317 |
| 4,491,692 | 1/1985 | Lee | 179/90 L |

FOREIGN PATENT DOCUMENTS

| | | | |
|---|---|---|---|
| 1496640 | 12/1977 | United Kingdom | 200/5 A |

*Primary Examiner*—A. D. Pellinen
*Assistant Examiner*—Morris Ginsburg
*Attorney, Agent, or Firm*—Rolland R. Hackbart

[57] ABSTRACT

A keypad assembly is described that includes a novel elastomeric membrane keypad (120) sandwiched between a housing (110) and a circuit board 130. Keypad (120) is comprised of a sheet (122) and a plurality of keys (124) protruding therefrom. Keys (124) have carbon pads (220) on the bottom for producing electrical signal continuity between corresponding pairs of contacts on circuit board (130). Then sheet (122) further includes ridges (310) at the periphery of its top surface and surrounding each key (124). When keypad (120) is compressed between housing (110) and circuit board (130), ridges (310) produce a high compression seal around each key (124), thereby improving the tactile response thereof. Sheet (122) of keypad (120) also includes cavities (210) for light sources (410) on circuit board (130). The light from light sources (410) is conducted by sheet (122) throughout keypad (120) for brightly and evenly illuminating keys (124). The novel elastomeric membrane keypad (120) may be advantageously used in any application requiring a keyboard assembly.

23 Claims, 6 Drawing Figures

Fig. 5
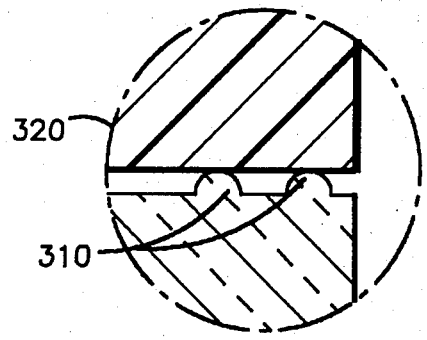
Fig. 3
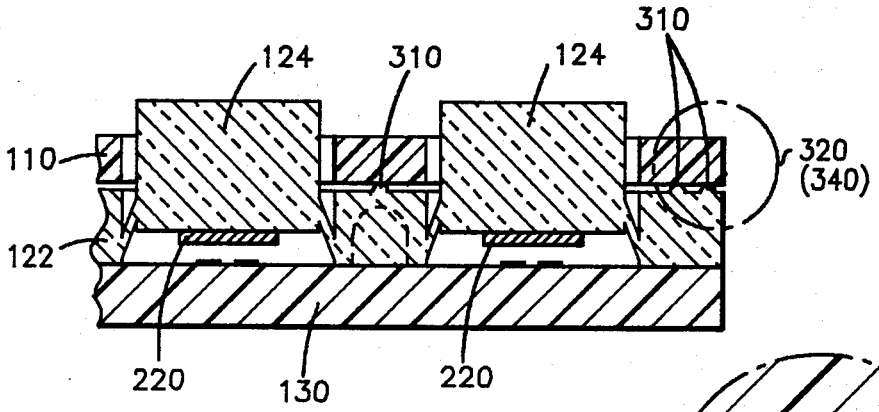
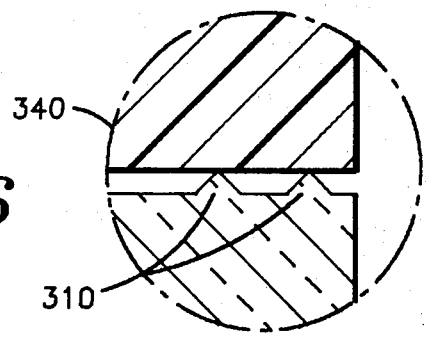
Fig. 6
Fig. 4
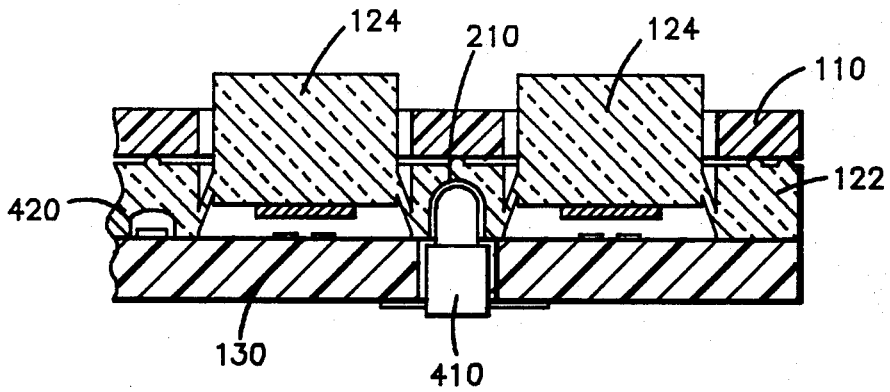

LIGHT CONDUCTING, ELASTOMERIC MEMBRANE KEYPAD

This is a continuation of Ser. No. 711,425, filed Mar. 13, 1985 and now abandoned.

BACKGROUND ART

The present invention is generally related to elastomeric membrane keypads and more particularly related to an improved light conducting, environmentally sealed, elastomeric membrane keypad for use in electrical devices such as portable radios.

In the prior art, elastomeric membrane keypads were typically used together with a hard plastic lightpipe for illuminating the keys thereon. The lightpipe is located between the keypad and the housing of the keypad assembly. In order to seal the keypad assembly, a two-sided adhesive pad must be placed between both the lightpipe and the keypad and between the lightpipe and the housing. Moreover, the lightpipe must be carefully designed taking into account diffraction angles of the media in order to produce adequate and even backlighting of the keys. For the foregoing reasons, there is a need for an improved elastomeric membrane keypad that eliminates the need for a separate lightpipe and the cost and problems associated therewith.

OBJECTS AND SUMMARY OF THE INVENTION

It an object of the present invention to provide an improved elastomeric membrane keypad that conducts light from one or more light sources for illuminating keys thereon.

It is another object of the present invention to provide an improved elastomeric membrane keypad that both conducts light for illuminating keys and produces a high compression seal that enhances the tactile response of the keys.

Briefly described, the present invention encompasses an elastomeric membrane keypad adapted to be disposed between a housing and a circuit board having pairs of contacts and a plurality of light sources. The novel elastomeric membrane keypad comprises: a translucent sheet having top and bottom surfaces, a thickness sufficient to absorb the light sources for conducting light from the light sources, and cavities each disposed opposite to a corresponding pair of contacts; a plurality of keys each disposed in a cavity, attached to the sheet substantially at the periphery of the bottom surface of the key, and having a portion extending below the top surface of the sheet for receiving conducted light therefrom; a plurality of electrically conductive areas each disposed on the bottom of a corresponding key and opposite to a corresponding pair of contacts for producing electrical signal continuity therebetween when the key is activated; and ridges disposed on the top surface of said sheet at the periphery thereof and around each key for producing an area of high compression both between the keypad and the housing and around each key, thereby improving the tactile response thereof.

BRIEF DESCRIPTION OF THE DRAWINGS

FIG. 3 is a cross sectional view of the elastomeric membrane keypad in FIG. 1 taken along lines 3—3.

FIG. 4 is another cross sectional view of the elastomeric membrane keypad in FIG. 1.

FIG. 5 is an enlarged view of circular-shaped ridges for use in elastomeric membrane keypad in FIG. 3.

FIG. 6 is an enlarged view of triangular-shaped ridges for use in elastomeric membrane keypad in FIG. 3.

DETAILED DESCRIPTION OF THE PREFERRED EMBODIMENT

Figure 1:
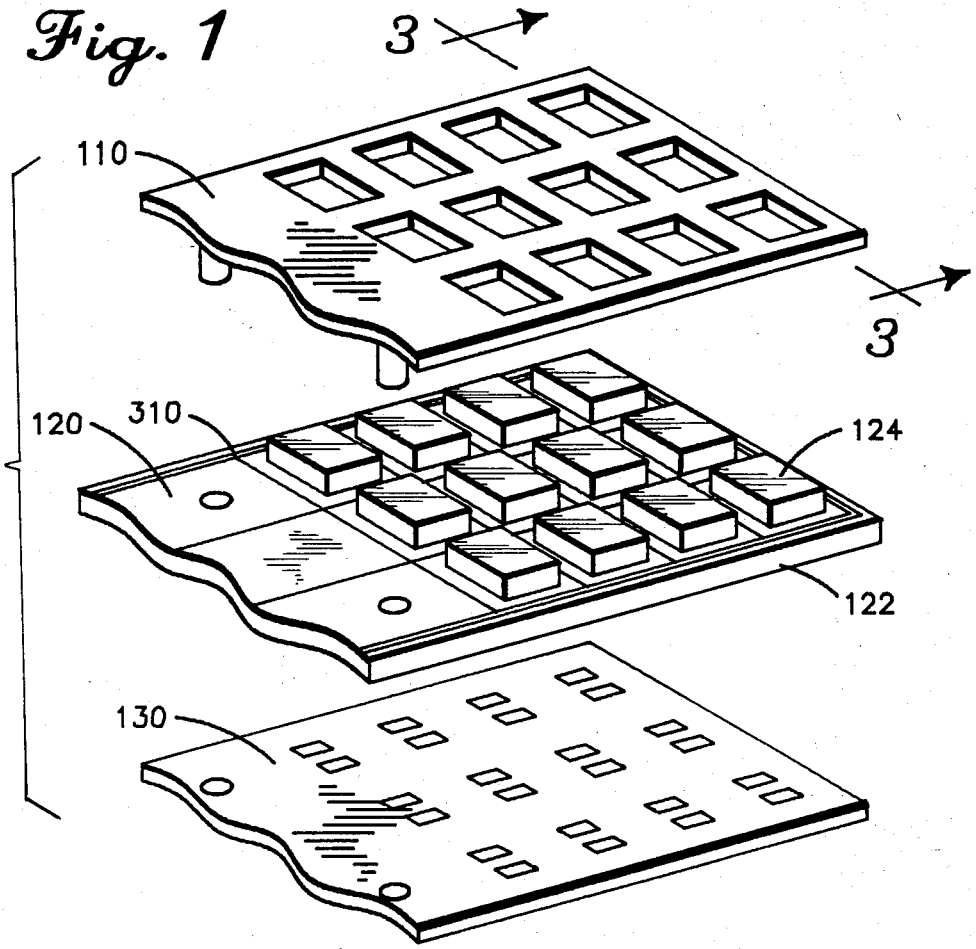
FIG. 1 is an exploded view of a keypad assembly including an elastomeric membrane keypad embodying the present invention.

In FIG. 1, there is illustrated a keyboard assembly including a housing 110, a circuit board 130 and an elastomeric membrane keypad 120 embodying the present invention. Housing 110 includes holes through which keys 124 of keypad 120 insert, and further includes two or more posts for orienting keypad 120. Keypad 120 is a unitary membrane including a plurality of keys 124 which protrude from a flat sheet of a predetermined thickness, and further including two holes for accepting corresponding posts of housing 110. Keys 124 may be rectangular, circular, square or any other suitable shape. Circuit board 130 includes a plurality of pairs of contacts each associated with a corresponding key 124 of keypad 120. According to a feature of the present invention, circuit board 130 may be flexible such that it conforms to the shape of housing 110 and the underlying structural elements. In other words, housing 110 and the underlying structural elements may have curved or irregular surfaces. Since elastomeric membrane keypad 120 and circuit board 130 may both be flexible, they will conform to the curved or irregular surfaces of housing 110 and the underlying structural elements.

Keypad 120 is preferably comprised of an elastomeric membrane that is both relatively soft to provide tactile feel and translucent for conducting light. In the preferred embodiment of the present invention, keypad 120 is comprised of silicone rubber. The translucence of the elastomeric membrane keypad 120 may be adjusted to soften hot spots from the light sources and to purposely obscure the circuit board 130 and other background material. Alphanumeric characters, symbols or other logos may be painted or screened onto the exposed surface of keypad 120. In the preferred embodiment of the present invention, keypad 120 is screened with the alphanumeric characters of a telephone type keypad for use in a portable radio of the type shown in U.S. Pat. Nos. D269,873 and D234,605 or in a telephone handset of the type shown in U.S. Pat. Nos. D271,491 and D270,835.

Figure 2:
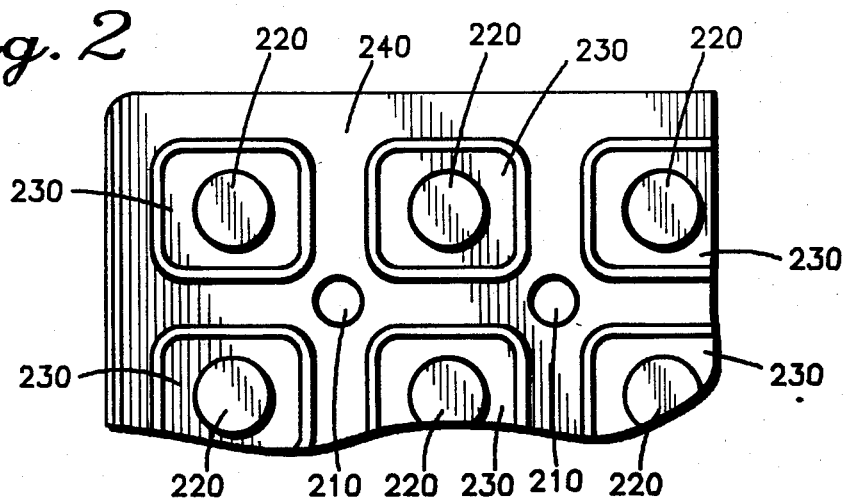
FIG. 2 is a partial back side view of the elastomeric membrane keypad in FIG. 1.

According to an important feature of the present invention, keypad 120 conducts light from the light sources on circuit board 130 for brightly and evenly illumninating the keys 124 thereon. Each light source may be surface mounted on circuit board 130 or may insert into a corresponding cavity 210 in FIG. 2 for feeding light into sheet 122 of keypad 120. Two cavities 210 may be located between groups of two rows of keys 124 as illustrated in FIG. 2. The thickness of sheet 122 is selected to be sufficient to conduct light and accommodate the cavities 210 or surface-mount light sources. Since keys 124 have a portion extending below the top surface of sheet 122, light conducted by sheet 122 may pass directly into each key 124. In the preferred embodiment of the present invention, the thickness of sheet 122 is between 2.6 and 2.7 millimeters.

Although the preferred embodiment of the present invention utilizes cavities 210 in FIG. 2 for the light sources, the present invention also contemplates the use of a sheet 122 of sufficient thickness to absorb the light sources, as illustrated in FIG. 4 by surface-mount light source 420. Light source 420 may be a surface-mount chip light-emitting-diode. Since it is mounted on the surface of circuit board 130, light source 420 is pushed into and absorbed by sheet 122 during mounting. Elastomeric sheet 122 is defomed by light source 420 creating a compression fit therebetween that improves the conduction of light throughout.

The translucency of elastomeric material such as silicone rubber, used in keypad 120 can be adjusted to provide the desired degree of brightness. For example, colored dyes or pigments can be added to silicone rubber to adjust its color from white to various shades of yellow. Furthermore, areas 230 and 240 on the bottom of keypad 120 in FIG. 2 may be painted white to both reflect light back up toward the keys 124 and to obscure or prevent viewing of black carbon pads 220 and the circuit board 130.

Referring next to FIGS. 3 and 4, there are illustrated cross sectional views of the elastomeric membrane keypad 120 in FIG. 1, wherein the structure of the keys 124 is more clearly shown. Keys 122 extend above the top surface of sheet 122. Each key 124 is attached to sheet 122 at the periphery of the bottom surface of the key, and each key 124 further has a portion extending below the top surface of sheet 122 for receiving conducted light therefrom. A carbon pad 220 is bonded to the bottom of each key 124. Pad 220 may be comprised of a carbon impregnated material or an elastomer impregnated with electrically conductive particles. Alternatively, the bottom of keys 124 may be coated with any electrically conductive material. Carbon pads 220 are positioned opposite to corresponding pairs of contacts on circuit board 130. Actuation of key 124 causes carbon pad 220 to produce electrical continuity between the corresonding pair of contacts on circuit board 130. Moreover, circuit board 130 may be formed on a flexible substrate such that elastomeric membrane keypad 120 and circuit board 130 may be mounted on a curved or irregular surface.

According to yet another feature of the present invention, sheet 122 of keypad 120 also includes ridges 310 in FIG. 3 for producing a high compression seal when compressed between keypad 120 and housing 110. Ridges 310 are preferably comprised of an elastomer and therefore will conform to and accommodate uneven or irregular surfaces of circuit board 130. Moreover, ridges 310 need not be captivated by corresponding slots in housing 110 and circuit board 130 to produce a high compression seal. Two ridges 310 are provided on the periphery of sheet 122, and one ridge 310 surrounds each key 124. The pattern of the ridges 310 can be more clearly ascertained in FIG. 1. Ridges 310 can have any suitable shape, such as, for example, a circular shape as shown in detail 320 in FIG. 5 or a triangular shape as shown in detail 340 in FIG. 6. Ridges 310 not only provide for an environmental seal but also inreases the rigidity or stiffness of the elastomeric sheet 122 around the keys 124 resulting in a greater degree of tactile response when actuating the keys 124. Thus, due to the greater degree of tactile response, ridges 310 render the novel keyboard of the present invention more attractive to the user.

Referring to FIG. 4, there is illustrated a cross sectional view of keypad 120 showing in more detail cavities 210 and light sources 410 and 420. Light sources 410 and 420 may be any suitable devices, such as, for example, light emitting diodes. Two light sources are disposed between each set of two rows of keys 124. In the preferred embodiment of the present invention, six light sources are utilized. Light emitted from light sources 410 and 420 enters the surrounding sheet 122 and is conducted throughout keypad 120 for brightly and evenly illuminating keys 124. In order to capture as much light from light sources 410 and 420 as possible, light source 410 may press fit into cavity 210 and light source 420 is directly pressed into elastomeric sheet 122. Therefore, according to an important feature of the present invention, light is transferred more efficiently into sheet 122. As a result, the intensity of light sources 410 and 420 can be reduced while at the same time brightly and evenly illuminating keys 124. By utilizing the novel keypad of the present invention, as much as 40% less current is required for illuminating keypad. In portable radio applications, reducing standby current drain from the portable radio battery extends the usable battery life since the battery does not have to be recharged as frequently.

In summary, a novel, unitary elastomeric membrane keypad has been described that both conducts light for illuminating keys and produces a high compression seal when mounted in a housing. Light is conducted from light sources throughout the keypad by means of a sheet which forms the bottom portion of the keypad. Ridges on the surface of the sheet produce a high compression seal when compressed against the housing of the keyboard assembly, resulting in both an environmental seal and enhanced tactile response of the keys. The novel elastomeric membrane keypad of the present invention can be advantageously used in any application requiring a keyboard assembly.

We claim:

1. An elastomeric membrane keypad adapted to be disposed between a housing and a circuit board having pairs of contacts and a plurality of light sources, said elastomeric membrane keypad comprising:

translucent sheet means having a top surface and a bottom surface and a predetermined thickness for conducting light from the light sources, and said sheet means further having a plurality of cavities and having a plurality of protruding keys each having a top surface and a bottom surface, each key attached to the bottom surface of said sheet means substantially at the periphery of the bottom surface of the key, and each key further having a portion extending below the top surface of said sheet means for directly receiving conducted light therefrom;

a plurality of electrically conductive means each disposed on the bottom surface of a corresponding key; and ridge means disposed on the top surface of said sheet means at the periphery thereof and around each key for producing an area of high compression both between the keypad and the housing and around each key, whereby the tactile response of said keys is enhanced.

2. The elastomeric membrane keypad according to claim 1, wherein said sheet means, keys and ridge means are comprised of silicone rubber.

3. The elastomeric membrane keypad according to claim 1, wherein said sheet means, keys and ridge means are comprised of an elastomer, and said conductive means is comprised of an elastomer impregnated with conductive particles.

4. The elastomeric membrane keypad according to claim 1, wherein said sheet means is comprised of an elastomeric membrane having a thickness of between 2.6 and 2.7 millimeters.

5. The elastomeric membrane keypad according to claim 1, wherein said ridge means includes two adjacent ridges disposed on the top surface of said sheet means at the periphery thereof.

6. A keypad assembly, comprising:

a housing;

a circuit board disposed in said housing and having pairs of contacts and a plurality of light sources; and keypad means disposed between said housing and said circuit board and including:

translucent sheet means comprised of an elastomer, having a top surface and a bottom surface and a predetermined thickness for conducting light from the light sources, and said sheet means further having a plurality of cavities and having a plurality of protruding keys each having a top surface and a bottom surface, each key attached to the bottom surface of said sheet means substantially at the periphery of the bottom surface of the key, and each key further having a portion extending below the top surface of said sheet means for directly receiving conducted light therefrom;

a plurality of electrically conductive means each disposed on the bottom surface of a corresponding key and opposite to a corresponding pair of contacts for producing electrical signal continuity therebetween when the key is activated; and ridge means comprised of an elastomer and being disposed on the top surface of said sheet means at the periphery thereof and around each key for producing an area of high compression both between the keypad and the housing and around each key, whereby the tactile response of said keys is enhanced.

7. The keypad assembly according to claim 16, wherein said sheet means, keys and ridge means are comprised of silicone rubber.

8. The keypad assembly according to claim 6, wherein said sheet means, keys and ridge means are comprised of an elastomer, and said conductive means is comprised of an elastomer impregnated with conductive particles.

9. The keypad assembly according to claim 6, wherein said sheet means is comprised of an elastomeric membrane having a thickness of between 2.6 and 2.7 millimeters.

10. The keypad assembly according to claim 6, wherein said ridge means includes two adjacent ridges disposed on the top surface of said sheet means at the periphery thereof.

11. A keypad assembly, comprising:

a housing having a predetermined shape;

a flexible circuit board disposed in said housing and having pairs of contacts and a plurality of light sources, said circuit board adapted to conform to the shape of said housing; and keypad means disposed between said housing and said circuit board and including:

translucent sheet means comprised of an elastomer, having a top surface and a bottom surface and a predetermined thickness for conducting light from the light sources, and said sheet means further having a plurality of cavities and having a plurality of protruding keys each having a top surface and a bottom surface, each key attached to the bottom surface of said sheet means substantially at the periphery of the bottom surface of the key, and each key further having a portion extending below the top surface of said sheet means for directly receiving conducted light therefrom;

a plurality of electrically conductive means each disposed on the bottom surface of a corresponding key and opposite to a corresponding pair of contacts for producing electrical sigsed on the bottom surface of a corresponding key and opposite to a corresponding pair of contacts for producing electrical signal continuity therebetween when the key is activated; and ridge means comprised of an elastomer and being disposed on the top surface of said sheet means at the periphery thereof and around each key for producing an area of high compression both between the keypad and the housing and around each key, whereby the tactile response of said keys is enhanced.

12. The keypad assembly according to claim 11, wherein said sheet means, keys and ridge means are comprised of silicone rubber.

13. The keypad assembly according to claim 11, wherein said sheet means, keys and ridge means are comprised of an elastomer, and said conductive means is comprised of an elastomer impregnated with conductive particles.

14. The keypad assembly according to claim 11, wherein said sheet means is comprised of an elastomeric membrane having a thickness of between 2.6 and 2.7 millimeters.

15. The keypad assembly according to claim 11, wherein said ridge means includes two adjacent ridges disposed on the top surface of said sheet means at the periphery thereof.

16. An elastomeric membrane keypad adapted to be disposed between a housing and a circuit board having pairs of contacts and at least one light source, said elastomeric membrane keypad comprising:

translucent sheet means having a top surface and a bottom surface and a predetermined thickness for conducting light from the light source, and said sheet means further having a plurality of cavities and having a plurality of protruding keys each having a top surface and a bottom surface, each key attached by a relatively thin support leg portion to the bottom surface of said sheet means substantially at the periphery of the bottom surface of the key, and each key further having a portion extending below the top surface of said sheet means for directly receiving conducted light therefrom; and a plurality of electrically conductive means each disposed on the bottom surface of a corresponding key.

17. The keypad according to claim 16, wherein said sheet means is comprised of silicone rubber.

18. A keypad assembly, comprising:

a housing;

a circuit board disposed in said housing and having pairs of contacts and at least one light source; and keypad means disposed between said housing and said circuit board and including:

translucent sheet means comprised of an elastomer, having a top surface and a bottom surface and a predetermined thickness for conducting light from the light source, and said sheet means further having a plurality of cavities and having a plurality of protruding keys each having a top surface and a bottom surface, each key attached by a relatively thin support leg portion to the bottom surface of said sheet means substantially at the periphery of the bottom surface of the key, and each key further having a portion extending below the top surface of said sheet means for directly receiving conducted light therefrom; and a plurality of electrically conductive means each disposed on the bottom surface of a corresponding key and opposite to a corresponding pair of contacts for producing electrical signal continuity therebetween when the key is activated.

19. The keypad assembly according to claim 18, wherein said sheet means is comprised of silicone rubber.

20. The keypad assembly according to claim 18, further including at least a second light source, and wherein said keys are arranged in rows and each light source is located in the area between said rows.

21. A keypad assembly, comprising:

a housing having a predetermined shape;

a flexible circuit board disposed in said housing and having pairs of contacts and at least one light source, said circuit board adapted to conform to the shape of said housing; and keypad means disposed between said housing and said circuit board and including:

translucent sheet means comprised of an elastomer, having a top surface and a bottom surface and a predetermined thickness for conductng light from the light source, and said sheet means further having a plurality of cavities and having a plurality of protruding keys each having a top surface and a bottom surface, each key attached by a relatively thin suport leg portion to the bottom surface of said sheet means substantially at the periphery of the bottom surface of the key, and each key further having a portion extending below the top surface of said sheet means for directly receiving conducted light therefrom; and a plurality of electrically conductive means each disposed on the bottom surface of a corresonding key and opposite to a corresponding pair of contacts for producing electrical signal continuity therebetween when the key is activated.

22. The keypad assembly according to claim 21, wherein said sheet means is comprised of silicone rubber.

23. The keypad assembly according to claim 21, further including at least a second light source, and wherein said keys are arranged in rows and each light source is located in the area between said rows.

* * * * *

UNITED STATES PATENT AND TRADEMARK OFFICE

CERTIFICATE OF CORRECTION

PATENT NO. : 4,636,593

DATED : January 13, 1987

INVENTOR(S) : Carl V. Novak and Ronald R. Browne

It is certified that error appears in the above-identified patent and that said Letters Patent is hereby corrected as shown below:

Column 5, line 45 delete "16" and add --6-- in its place.

Column 6, lines 17, 18, 19 and 20, delete "sigsed on the bottom surface of a corresponding key and opposite to a corresponding pair of contacts for producing electrical".

Column 8, line 22, correct the spelling of "corresonding" to --corresponding--.

Signed and Sealed this

Twenty-first Day of April, 1987

*Attest:*

DONALD J. QUIGG

*Attesting Officer*

*Commissioner of Patents and Trademarks*